US005120613A

United States Patent [19]

Basler et al.

[11] Patent Number: 5,120,613

[45] Date of Patent: Jun. 9, 1992

[54] POCESS FOR INCREASING THE RESISTANCE TO CORROSION AND EROSION OF A VANE OF A ROTATING HEAT ENGINE

[75] Inventors: Benno Basler, Strengelbach; Tibor Koromzay, Wettingen, both of Switzerland

[73] Assignee: Asea Brown Boveri Ltd., Baden, Switzerland

[21] Appl. No.: 683,472

[22] Filed: Apr. 9, 1991

Related U.S. Application Data

[63] Continuation of Ser. No. 452,604, Dec. 19, 1989, abandoned.

[30] Foreign Application Priority Data

Jan. 26, 1989 [CH] Switzerland ..... 252/89

[51] Int. Cl.[5] ..... B32B 15/01; B05D 1/08

[52] U.S. Cl. ..... 428/653; 427/423; 427/34; 427/421; 427/327; 427/409; 428/937

[58] Field of Search ..... 427/423, 422, 421, 34, 427/327, 409; 428/653, 937

[56] References Cited

U.S. PATENT DOCUMENTS 4,444,804 4/1984 Ferrari ..... 427/34
4,707,379 11/1987 Neufuss et al. ..... 427/34

FOREIGN PATENT DOCUMENTS 0092959 11/1983 European Pat. Off. .
973012 10/1964 United Kingdom .

OTHER PUBLICATIONS

Patent Abstracts of Japan, vol. 5, No. 178 (C-78) (850), Nov. 14, 1981, & JP, A, 56-102546, M. Hashimoto, "Sliding Member", Aug. 17, 1981.
Patent Abstracts of Japan, vol. 9, No. 309 (C-318) (2032), Dec. 5, 1985, & JP, A, 60-149761, Aug. 7, 1985, I. Asakawa, "Coating Method For Providing Corrosion Resistance".
Patent Abstracts of Japan, vol. 13, No. 137 (C-582) (3485), Apr. 5, 1989 & JP, A, 63-303048, Dec. 9, 1988, S. Kato, "Shift Fork".
The American Society of Mechanical Engineers, 82-G-T-244, pp. 1-9, F. N. Davis, et al., "Engine Experience of Turbine Rotor Blade and Coatings".
SAE Technical Paper Series 860112, International Congress and Exposition, Detroit, Mich., Feb. 24-28, 1986, pp. 47-58, M. F. Mosser, et al., "Evaluation of Aluminum/Ceramic Coating on Fasteners to Eliminate Galvanic Corrosion".
The American Society of Mechanical Engineers, 86-G-T-306, pp. 1-7, International Gas Turbine Conference and Exhibit, Dusseldorf, West Germany-Jun. 8-12, 1986, T. F. Lewis III, "Gator-Gard, The Process, Coatings, and Turbomachinery Applications".
The American Society of Mechanical Engineers, 88-G-T-186, Gas Turbine and Aeroengine Congress, Amsterdam, The Netherlands-Jun. 6-9, 1988, pp. 1-6, H. J. Kolkman, "New Erosion Resistant Compressor Coatings".

*Primary Examiner*—Michael Lusignan
*Assistant Examiner*—Roy V. King
*Attorney, Agent, or Firm*—Oblon, Spivak, McClelland, Maier & Neustadt

[57] ABSTRACT

Process for increasing the resistance to corrosion and erosion of a vane of a rotating heat engine, which vane consists essentially of a ferritic and/or ferritic-martensitic base material, in that a firmly adhering protective surface layer consisting of 6 to 15% by weight of Si, the remainder being Al, is sprayed onto the surface of the base material using the high-speed process with a particle velocity of at least 300 m/s.

6 Claims, No Drawings

POCESS FOR INCREASING THE RESISTANCE TO CORROSION AND EROSION OF A VANE OF A ROTATING HEAT ENGINE

This application is a continuation of U.S. application Ser. No. 07/452,604, filed on Dec. 19, 1989, now abandoned.

BACKGROUND OF THE INVENTION

1. Field of the Invention

Vanes for rotating heat engines such as steam turbines, gas turbines, turbocompressors, etc. and their effective protection against attacks during operation such as oxidation, corrosion, wear and damage.

The invention relates to the improvement of the resistance to corrosion and erosion of vanes of rotating heat engines by further developing the process for applying suitable protective layers.

In particular, the invention concerns a process for increasing the resistance to corrosion and erosion of a vane of a rotating heat engine, which vane consists essentially of a ferritic and/or ferritic-martensitic base material, by applying a firmly adhering protective surface layer.

2. Discussion of Background

In order to be able to satisfy the numerous demands, the vanes of rotating heat engines are often provided with protective layers. Use is made of these both in the case of steam turbine vanes and gas turbine vanes and also in the case of compressor vanes. The aim, above all, is to increase the resistance to corrosion and oxidizing attack, and also to erosion and wear. Among the materials employed for protective layers, the elements of Cr, Al, Si, which form oxidic top layers, assume a special position. Layers which have a high Al content are employed inter alia as filler for carbide-containing coatings ($Cr_2C_3$; WC) in engine manufacturing.

The following publications on the prior art may be specified:

F. N. Davis, C. E. Grinnell, "Engine Experience of Turbine Rotor Blade Materials and Coatings", The American Society of Mechanical Engineers, 345 E. 47 St. New York, N.Y. 10017, 82-GT-244

SermeTel Technische Information (SermeTel Technical Information): "SermaLoy J-Prozess STS" (SermeLoy J-Process STS), SermeTel GmbH, Weilenburgstrasse 49, D-5628 Heiligenhaus, Federal Republic of Germany Mark F. Mosser and Bruce G. McMordie, "Evaluation of Aluminium/Ceramic Coating on Fasteners to Eliminate Galvanic Corrosion", Reprinted from. SP-649-Corrosion: Coatings and Steels, International Congress and Exposition, Detroit, Michigan, Feb. 24–28, 1986, ISSN 0148-7191, Copyright 1986 Society of Automotive Engineers, Inc.

Thomas F. Lewis III, "Gator-Gard, The Process, Coatings, and Turbomachinery Applications", Presented at the International Gas Turbine Conference and Exhibit, Düsseldorf, West Germany - Jun. 8–12, 1986, The American Society of Mechanical Engineers, 345 E. 47 St., New York, N.Y. 10017, 86-GT-306

H. J. Kolkman, "New Erosion Resistant Compressor Coatings", Presented at the Gas Turbine and Aero-engine Congress, Amsterdam, The Netherlands - Jun. 6–9, 1988, The American Society of Mechanical Engineers, 345 E. 47 St., New York, N.Y. 10017, 88-GT-186.

SUMMARY OF THE INVENTION

Accordingly, one object of this invention is to provide a novel process for increasing the resistance to corrosion (Cl ions and $SO_4$ ions) and erosion (particle impingement erosion and drop impingement erosion of a vane of a rotating heat engine in the presence of $H_2O$ vapor and at comparatively moderate temperatures (450° C.), which is particularly suited for ferritic and/or ferritic-martensitic base material of the vanes, the aim being to achieve a suitable surface layer cost effectively and without great effort/outlay. In particular, the aim is to avoid, or at least delay, the occurrence of pitting corrosion, in order to guarantee the vane a longer service life.

This object is achieved in that in the process mentioned at the beginning a protective layer consisting of 6 to 15% by weight of Si, the remainder being Al, is sprayed onto the surface of the base material using the high-speed process with a particle velocity of at least 300 m/s.

DESCRIPTION OF PREFERRED EMBODIMENTS

The invention is described with reference to the following illustrative embodiments: Illustrative embodiment 1:

A compressor vane for an axial compressor was provided with a protective layer. The layer had a wing profile, the vane blade having the following dimensions:

| | |
|---|---|
| Width | 80 mm |
| Maximum thickness | 9 mm |
| Depth of profile | 14 mm |
| Radial length | 210 mm |

The material of the vane was a martensitic steel, which was available in a fully heat-treated structural state, and had the following composition:

| | |
|---|---|
| Cr | 12% by weight |
| Mo | 1% by weight |
| Ni | 0.5% by weight |
| C | 0.25% by weight |
| Fe | Remainder |

The vane was firstly degreased and cleaned in trichloroethane, whereupon the blade and the blade/root transition was sandblasted The coating of the vane was carried out using a high-speed flame-spray process with a particle velocity of 400 m/s and a gas velocity of 1000 m/s with nitrogen as conveying gas. An aluminum alloy of the following composition, which was available in powder form, was employed as coating material:

| | |
|---|---|
| Si | 12.8% by weight |
| Mn | 0.22% by weight |
| Mg | 0.34% by weight |
| Ti | 0.1% by weight |
| Al | Remainder |

In accordance with the coating process employed here and bearing the trade name "Jet-Kote", the aluminum alloy powder was conveyed by means of nitrogen into a combustion chamber operated with propane and oxygen. The liquified particles were spun onto the workpiece as fine drops at a high overpressure. In this process, the vane was located in an apparatus which covered the vane root. The application of the protective layer was done with a hand-operated spraygun. The applied protective layer was measured with reference to a metallographic section, and amounted to 8 to 15 μm on average. Using a conventional spray coating process, a plastic, in the present case polytetrafluoroethylene..) was applied to this metal protective layer. This smooth surface layer had an average thickness of 6 to 10 μm and a roughness of approximately 2 μm.

The coated compressor vane was subjected to a test for corrosion resistance. For this purpose, it was immersed in a testing solution, and thereafter agetreated in a climatic cabinet for 4 h. This cycle was repeated a total of 60 times. The testing solution consisted of an aqueous solution of the following salts:

| | |
|---|---|
| 220 g/l | $(NH_4)_2FeSO_4.6H_2O$ |
| 50 g/l | NaCl |
| pH | 3-3.5 |
| Temperature of climatic cabinet | 45° C. |
| Air humidity | 100% |
| Duration of testing/cycle | 4 h |
| Number of cycles | 60 |

The metallographic investigations showed that after these corrosion tests no changes could be established either on the applied layers or on the base material.

For the purpose of comparison, a compressor vane provided, using a conventional spray process, with one aluminum layer and one plastic layer, was tested. After 60 test cycles, the protective layers had largely been destroyed, and lamella scales had spalled off. Illustrative embodiment 2

A compressor vane of the same dimensions and composition was coated according to Example 1 with an aluminum alloy and a plastic. A scratch, parallel to the longitudinal axis, of length 10 mm and with a total average depth of 25 μm, whose profile thus still just included the base material with its apex, was now made on the coated vane. The vane was then subjected to the same corrosion tests as in Example 1. Thanks to the local-element formation (aluminum layer functions as a "sacrifice anode"), the base material was largely protected, while the aluminum layer was only slightly reduced at the flanks of the scratch. Because of the migration of the Al ions in the corrosive medium as "electrolyte", and its discharge at the electropositive electrode (Fe) of the base material, in many instances the corrosive attack is stopped. This simulation of the surface damage due to particles impinging during operation, and its behavior in a corrosive atmosphere demonstrated that in practical conditions of use a long service life can be expected for the protective layer according to the invention.

Illustrative embodiment 3

A compressor vane was provided with a protective layer. The wing of the vane blade had the following dimensions:

| | |
|---|---|
| Width | 100 mm |
| Maximum thickness | 10.5 mm |
| Depth of profile | 18 mm |
| Radial length | 265 mm |

The material of the vane consisted of a martensitic-austenitic dual-phase steel with a low austenite proportion, and was available in the heat-treated state. The composition was as follows:

| | |
|---|---|
| Cr | 15.5% by weight |
| Mo | 1.28% by weight |
| Ni | 5.4% by weight |
| C | 0.2% by weight |
| Fe | Remainder |

After the usual degreasing, cleaning and sandblasting, the vane blade was additionally carefully shotblasted. The edge zone of the base material was cold deformed and compacted by this surface treatment, so that it had compressive residual stresses. It was achieved in this way that the reversed fatigue strength (fatigue strength) was increased in operation by relieving the stresses on the tension side. An aluminum alloy of the following composition was employed to coat the vane using the high-speed flame-spray process with a particle velocity of 450 m/s and a gas velocity of 1200 m/s with nitrogen as conveying means:

| | |
|---|---|
| Si | 10.65% by weight |
| Mn | 0.37% by weight |
| Mg | 0.1% by weight |
| Al | Remainder |

The aluminum alloy was sprayed on using an industrial robot. 3 spray cycles were carried out. The thickness of the applied layer amounted on average to 90 to 100 μm. In addition, a plastic layer of approximately 10 to 15 μm thickness was applied to this metal protective layer using a conventional spray coating process.

The coated vane was subjected to the same test for corrosion as in Example 1. No sort of attack could be established with this test.

Illustrative embodiment 4

A used compressor vane with a wing profile was provided with a protective layer. The vane blade had the following dimensions:

| | |
|---|---|
| Width | 63 mm |
| Maximum thickness | 8 mm |
| Depth of profile | 12 mm |
| Radial length | 140 mm |

The base material of the vane was a martensitic steel in a high-strength heat-treated structural state, the composition of which is given below:

| | |
|---|---|
| Cr | 11.73% by weight |
| Mo | 0.8% by weight |
| V | 0.1% by weight |
| C | 0.22% by weight |
| Fe | Remainder |

The present case was concerned with a vane coated using a conventional process, which had considerable operational damage in the form of pitting corrosion, which partially extended to the base material This used vane was firstly degreased, reground and sandblasted, in order to remove the damage The surface zone of the base material was then compacted by shotblasting. The coating was done with an aluminum alloy of the following composition:

| | |
|---|---|
| Si | 6.84% by weight |
| Mn | 0.3% by weight |
| Mg | 0.36% by weight |
| Ti | 0.1% by weight |
| Al | Remainder |

The metal layer was sprayed on by hand using the high-speed flame-spray process. The thickness of the protective layer fluctuated between 25 and 45 μm. The result of the metallographic tests after the corrosion test described above was an unaltered, unaffected surface zone.

The invention is not limited to the illustrative embodiments.

The process for increasing the resistance to corrosion and erosion of a vane of a rotating heat engine, which vane consists essentially of a ferritic and/or ferritic-martensitic base material, is carried out by applying a firmly adhering protective surface layer, in that a protective layer consisting of 6 to 15% by weight of Si, the remainder being Al, is sprayed onto the surface of the base material using the high-speed process with a particle velocity of at least 300 m/s. Preferably, the base material consists of a chromiferous steel with 12 to 13% Cr by weight and further additions. In an advantageous fashion, the protective layer contains 10 to 12% Si by weight, the remainder being Al. In addition, in order to improve the surface a top layer made of a thermostable plastic is preferably applied to the said protective layer.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A process for increasing the resistance to corrosion and erosion of a vane of a rotating heat engine, which vane consists essentially of a ferritic and/or ferritic-matrensitic base material, comprising applying a firmly adhering protective surface layer consisting essentially of 6 to 15% by weight of Si, the remainder being Al, by spraying a material consisting essentially a powder of said protective surface layer onto the surface of the base material by means of a high-speed process with a particle velocity of at least 300 m/s.

2. The process as claimed in claim 1, wherein the base material consists of a chromiferous steel with 12 to 13% Cr by weight and further additions.

3. The process as claimed in claim 1, wherein the protective layer contains 10 to 12% Si by weight, the remainder being Al.

4. The process as claimed in claim 1, comprising additionally applying a top layer made of a thermostable plastic to the protective layer.

5. The process as claimed in claim 1, further comprising cold-deforming and compacting the edge-zone of said base material prior to applying the protective surface layer.

6. A protective layer with increased resistance to corrosion and erosion for a vane of a rotating heat engine, which protective layer is produced by the process according to claim 1.

* * * * *